US006679043B2

(12) United States Patent
Griesshammer et al.

(10) Patent No.: US 6,679,043 B2
(45) Date of Patent: Jan. 20, 2004

(54) SPINNING MACHINE

(75) Inventors: Christian Griesshammer, Winterthur (CH); Peter Anderegg, Winterthur (CH)

(73) Assignee: Maschinenfabrik Reiter AG, Winterthur (CH)

( * ) Notice: Subject to any disclaimer, the term of this patent is extended or adjusted under 35 U.S.C. 154(b) by 65 days.

(21) Appl. No.: 10/008,611

(22) Filed: Nov. 8, 2001

(65) Prior Publication Data

US 2002/0124545 A1 Sep. 12, 2002

(30) Foreign Application Priority Data

Nov. 8, 2000 (CH) ..... 2174/00

(51) Int. Cl.[7] ..... D01H 13/26; D01H 4/02

(52) U.S. Cl. ..... 57/264; 57/97; 57/317; 57/327; 57/350; 57/400

(58) Field of Search ..... 57/264, 315, 317, 57/327, 400, 408, 409, 412, 97, 350; 19/236, 238, 239, 240

(56) References Cited

U.S. PATENT DOCUMENTS

| | | | | |
|---|---|---|---|---|
| 4,506,414 A | | 3/1985 | Krieger | |
| 4,864,694 A | | 9/1989 | Konig et al. | |
| 5,046,013 A | * | 9/1991 | Ueda et al. | 700/139 |
| 5,272,790 A | * | 12/1993 | Demuth et al. | 19/98 |
| 5,481,860 A | | 1/1996 | Stahlecker et al. | |
| 5,501,100 A | * | 3/1996 | Baechler et al. | 73/37.7 |
| 5,815,889 A | * | 10/1998 | Barth et al. | 19/240 |
| 6,052,984 A | | 4/2000 | Summerer | |
| 6,286,188 B1 | * | 9/2001 | Muller et al. | 19/239 |

FOREIGN PATENT DOCUMENTS

| | | |
|---|---|---|
| DE | 3703450 A1 | 11/1987 |
| DE | 3703449 C2 | 8/1988 |
| DE | 3932614 A1 | 4/1990 |
| DE | 4140669 A1 | 6/1993 |
| DE | 19542599 A1 | 5/1997 |
| EP | 0176661 B1 | 4/1986 |
| EP | 0340756 B1 | 11/1989 |
| EP | 0365931 A1 | 5/1990 |
| EP | 0649923 B1 | 4/1995 |
| EP | 0289010 B1 | 11/1999 |
| WO | 9911847 | 3/1999 |
| WO | 9966113 | 12/1999 |
| WO | 0224993 A2 | 3/2002 |

OTHER PUBLICATIONS

EPO Search Report, Feb. 22, 2001.

* cited by examiner

*Primary Examiner*—John J. Calvert
*Assistant Examiner*—Shaun R Hurley
(74) *Attorney, Agent, or Firm*—Dority & Manning

(57) ABSTRACT

A spinning machine includes a plurality of spinning stations or places. Each spinning place includes a yarn formation mechanism that is supplied with staple fiber material in the form of a longitudinal object. Each spinning place includes a refining mechanism by way of which the longitudinal object is refined prior to the fiber material being supplied to a yarn formation mechanism. Each refining mechanism is independently drivable and controllable with respect to the other refining mechanisms. At least one sensor is disposed at each of the spinning places to detect at least one measurable property correlated with fiber mass per unit of length. A controlling monitoring unit is configured to receive and process data measured by the sensor. A control monitoring unit is configured with the refining mechanism at the associated spinning place for control of the refining mechanism as a function of the property detected and measured by the sensor independent of the refining mechanisms at other spinning places.

18 Claims, 6 Drawing Sheets

SPINNING MACHINE

BACKGROUND

The invention lies in the field of spinning and relates to a spinning machine having a plurality of spinning stations for spinning fiber material into a yarn. The invention further relates to a spinning arrangement with such a spinning machine.

Conventional spinning machines for producing yarns of staple fiber material usually comprise a plurality of spinning places, e.g. two by fifty spinning places, which are arranged in two rows. Every spinning place is supplied with the fiber material in the form of a longitudinal object (e.g. sliver, slubbing or roving yarn) usually from a respective container (can) or from a bobbin and a yarn is formed in the spinning place from the supplied fiber material.

The actual yarn formation occurs for example by ring spinning, can spinning, cap spinning, friction spinning, rotor open-end spinning, air-vortex spinning, etc., with each spinning place comprising the apparatus parts required for the yarn formation and for winding up the formed yarn. Such apparatus parts of all spinning places are usually driven by way of a common driven or a small number of common drives and can be disconnected from said drive for individual spinning places (yarn breakage, change of can).

Prior to the actual yarn formation, the supplied longitudinal object of the fiber material is refined in the spinning machine by drafting or opening for example. For such refining the spinning machine comprises refining means, i.e. means for drafting such longitudinal objects or means for opening such longitudinal objects. The refining means are usually provided jointly for all spinning places or for a number of spinning places, as are the means for yarn formation for each spinning place. A single central drive or a small number of individual drives is provided for driving the refining means, as is also commonly applied for the yarn formation, which drives each assume a driving function for the refining means. It is also known to use separate small drives for each spinning place or even in each spinning place for each drive function.

Means for refining prior to yarn formation by drafting the supplied longitudinal fiber object are provided for example with three pairs of cylinders disposed in series which are driven in the direction of conveyance with increasing circumferential speed. Such pairs of cylinders extend for example along a row of spinning places and are driven for example by way of respective gears by a single drive or one separate drive is provided for each pair of cylinders (drive function). Within the terms of the aforementioned refining means which are driven internally in the spinning places, the publication DE-3932614 (Murata Kikai) describes drafting arrangements for each spinning place with a plurality of drives, which drafting arrangements can be adjusted individually. This allows producing different yarns on one and the same spinning machine and, optionally, individually adapting the drafting process to fine spinning-place-internal differences.

Means for refining the yarn formation by opening the supplied longitudinal fiber objects are provided for each spinning place for example with a feed roller, an opening roller and a fiber guide conduit leading the fibers in the opened state from the opening roller to the yarn formation zone. The entirety of the feed rollers and the entirety of the opening rollers are each driven by a common drive for example.

The yarns formed in the individual spinning places are monitored for example online or periodically by sensors and spinning places which perform poorly are disconnected from common drives. The disconnection can relate to the yarn formation or additionally also to the refining which is positioned upstream of the yarn formation.

It is also known to monitor the yarn formation (e.g. in the air-vortex spinning method) at each spinning place online or by periodic measurements and to individually regulate or adjust the machine parts which are used for yarn formation during the spinning process. Such regulations or adjustments relate to the supply of air to the spinning jet or the speed of the take-off rollers which are disposed downstream of the spinning jets. Respective methods and apparatuses are described for example in the publications EP-0289010 (Rieter) or EP-0365931 (Schubert & Salzer).

High requirements are placed on yarns which are produced with the spinning machines as briefly described above, especially their evenness concerning fiber mass per unit of length. According to the state of the art, these high requirements are fulfilled in such a way that the longitudinal fiber objects, before they are supplied to the spinning machine, are evened out to a very high degree in an evening process which particularly comprises several successive cycles of mixing and drafting. This ensures that the longitudinal objects as supplied to the spinning places already meet the requirements placed on evenness and that as a result it is sufficient to substantially keep the refining and spinning parameters constant during the spinning process and especially in each spinning place.

For the evening of the fiber material prior to spinning, a plurality of so-called autoleveller draw frames are used in which a plurality of incoming longitudinal fiber objects (e.g. from the carding machine or from the upstream autoleveller draw frame) are mixed and the fiber mixture is drawn. In order to even out the fiber mass per unit of length, the drafting ratio is controlled or regulated on the basis of mass measurements at the entrance and/or exit of the autoleveller draw frame, which occurs in such a way that the speed of at least one pair of cylinders in the drafting arrangement is changed. Such autoleveller draw frames receive the longitudinal fiber object from storage containers (cans) and supply the produced longitudinal fiber object again to storage containers from which the longitudinal fiber objects are finally supplied to a spinning machine or a spinning place. The management of such storage containers is very laborious, especially when the same is to be performed fully automatically. Without automation or with only partial automation, the management of the storage containers is work intensive and susceptible to errors.

SUMMARY

It is an object of the present invention to provide a spinning machine which can produce yarns of high evenness concerning fiber mass per unit of length, even though the fiber material supplied to the spinning places is provided with a lower such evenness than would be required for known spinning machines for the same yarn quality. Additional objects and advantages of the invention will be set forth in part in the following description, or may be obvious from the description, or may be learned through practice of the invention.

The spinning machine in accordance with the invention, which like the known spinning machine, comprises a plurality of spinning places arranged in such a way that the refining step (e.g. drawing or opening) for each spinning place, which is provided upstream of the effective yarn formation, is controlled and/or regulated on the basis of measured data as determined at the same spinning place concerning fiber mass per unit of length. For this purpose, the spinning machine in accordance with the invention is provided for each spinning place with sensor means for detecting at least one property correlating with the fiber mass per unit of length of the supplied fiber material and/or the produced yarn, as well as refining means which are controlled and/or regulated specific to each spinning place at least partly on the basis of the measured data detected by the sensor means. Optionally, the yarn formation which is provided downstream of the refining is also controlled or regulated specifically to each spinning place.

In such an equipped spinning machine, it is possible to perform directly and continuously at least a part of the evening concerning fiber mass per unit of length in each spinning place, so that at least a part of the evening steps which are performed discontinuously according to the state of the art (with the help of cans or bobbins) can be omitted. Optionally, it is even possible to omit discontinuously performed evening steps completely, thus making a completely continuously performable spinning process potentially feasible.

When the longitudinal fiber objects are supplied directly to the spinning places of the spinning machine in accordance with the invention within the terms of a continuous spinning process and when, between upstream apparatuses and spinning places which supply the longitudinal fiber object there are provided regions with free slack of the longitudinal fiber objects as a buffer, it is also possible, within certain limits which are predetermined by the spinning method and by the arrangement of the spinning place, to adapt the output of the individual spinning places to the filling level of the buffers or to output of the upstream apparatus. For this purpose, a spinning place is controlled in its entirety for an increase or decrease of its output. A buffer storage means which is known from the publication WO-99/1 1847 and connects a carding machine and an autoleveller draw frame for example can be adapted accordingly as a buffer storage means for a direct connection of an apparatus supplying a longitudinal fiber object and a buffer storage means of a spinning place of the spinning machine as to be provided in accordance with the invention.

A further advantage of the spinning machine in accordance with the invention is that for the start spinning (after a yarn breakage or change of can) refining means and, optionally, the yarn formation means can run through a start spinning cycle which is completely independent from other spinning places and in which the speeds of moved parts increase continuously for example. As a result, start spinning becomes considerably easier than in machines according to the state of the art in which moved parts can be coupled merely with a drive running with constant speed, which leads to a step-like or at least very steep increase of the respective speeds.

In the simplest of cases, sensor means of the spinning machine according to the invention detect for each spinning place the fiber mass in the zone of the entrance of the refining means and the inflow speed to the refining means is respectively varied by a respective control of the refining means. Further control methods which are also applicable are known from autoleveller draw frames or carding machines and are usually realized as closed loop control with a measuring element disposed downstream of the actuating element and/or as open loop control with a measuring element disposed upstream of the actuating element. Usually the closed loop control is used to compensate relatively long-wave fluctuations and the open loop control is used to compensate relatively short-wave fluctuations.

In order to compensate any irregularities or fluctuations in the fiber mass as detected by the sensor means, the draft of the fiber mass is essentially varied in the spinning place, which occurs in such a way that the inflow speed of the fiber mass into the spinning place and/or the outflow speed of the yarn from the spinning place is respectively controlled or regulated.

In the case of an inflow control, the longitudinal fiber objects are preferably supplied to the spinning places from cans or from bobbins, so that apparatuses which supply the longitudinal fiber objects are not influenced by fluctuations of the inflow speed into the spinning place.

The yarn formation means must also be provided with a controllable arrangement for an outflow control in addition to the refining means. This is possible within wide margins and with a relatively high speed especially for air-vortex spinning methods, for which the yarn properties are independent within relatively wide margins from the spinning speed and in which no large masses need to be accelerated or braked for a change in the spinning speed (small inertia). Such air-vortex spinning can be false twisting or at least partly real twisting (so-called vortex spinning methods) and are usually performed with the help of a spinneret and a pair of take-off rollers. The fiber twisting is produced by the spinneret by a fluid supplied to the nozzle. The pair of take-off rollers and the fluid supply must be controlled accordingly to produce a change in the spinning speed and/or spinning draft. An air-vortex spinning method which is particularly suitable for a spinning-place-internal outflow closed-loop control is described for example in the Swiss patent application 1845/00 (application date: Sep. 22, 2000).

Ring spinning, open-end, and friction spinning methods are not so suitable for the aforementioned outflow closed-loop control, because for these methods the yarn properties are independent from the spinning speed in only narrow margins. A wider margin in which the yarn properties are independent from the spinning speed is offered by the can spinning method. This method is not very suitable, however, for an outflow closed-loop control due to the relatively large rotating masses.

Known open-loop and closed-loop control methods for evening fiber masses which are designed for autoleveller draw frames or carding machines can be applied to refining means of individual spinning places of the spinning machine in accordance with the invention and the machine parts required for this purpose can easily be adapted to the application in accordance with the invention by a man skilled in the art. Such open-loop and closed control methods are described for example in the following publications: WO-99/66113 (Rieter, autoleveller draw frame), EP-176661 (Zellweger, autoleveller draw frame), U.S. Pat. No. 4,864,694 or U.S. Pat. No. 4,506,414 (Zinser, autoleveller draw frame), EP-340756 (TrUtzschler, autoleveller draw frame), EP-649923 (Howa, autoleveller draw frame), DE-3703450 and DE-3703449 (Trützschler, carding machine).

Embodiments of the spinning machine according to the invention which are shown as examples are described in detail in the schematic figures below. All figures only show one spinning place each of the spinning machine. The entire spinning machine is provided with a plurality of such spinning places which are arranged in at least one row.

The figures show:

DETAILED DESCRIPTION

Figure 1:
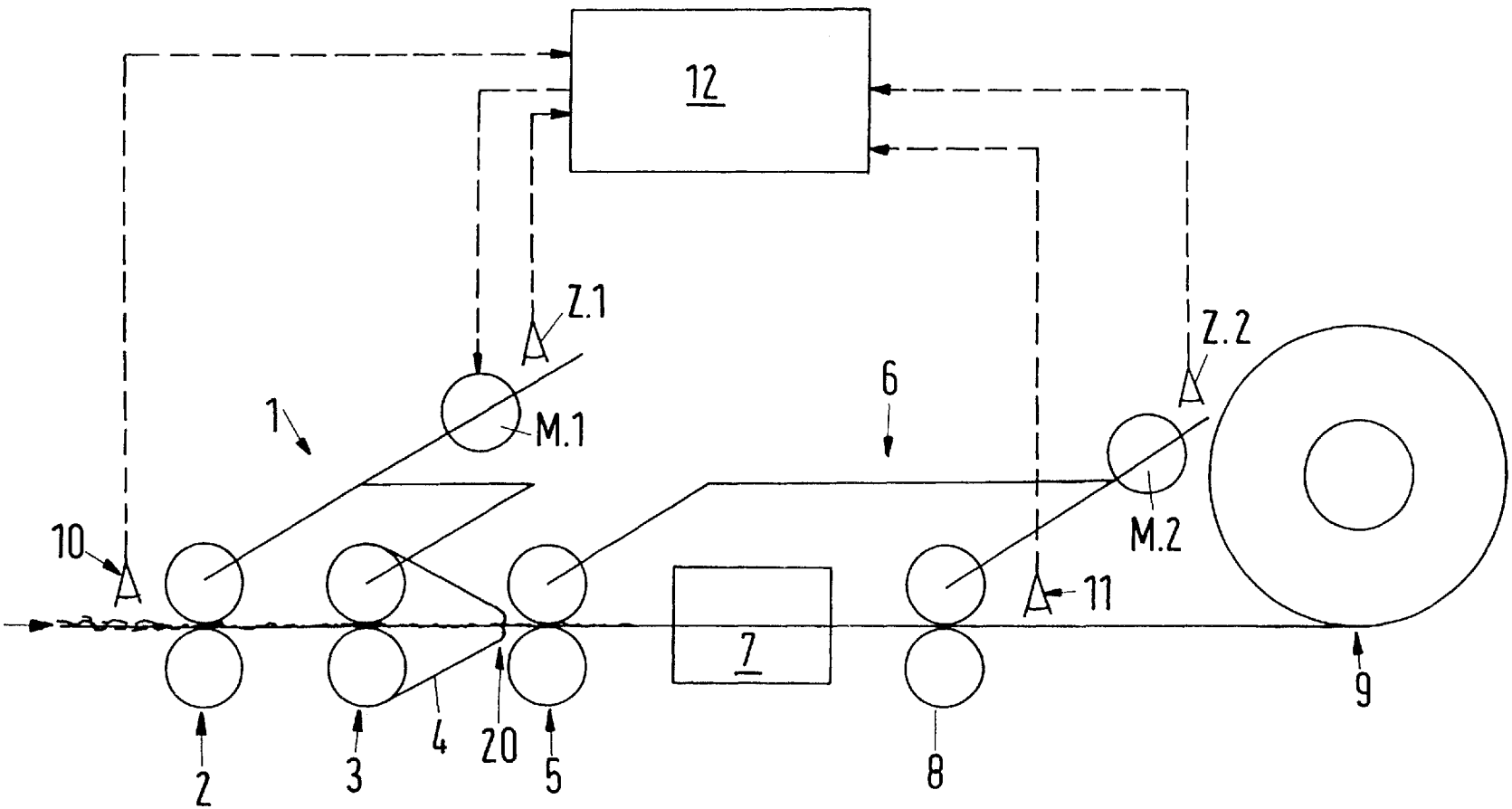
FIG. 1 shows a spinning place by way of example with a drafting arrangement specific to the spinning places and an open-loop and closed-loop control of the drafting arrangement specific to the spinning places (inflow) for evening the fiber mass per unit of the length of the yarn produced in the spinning place.

Reference will now be made in detail to embodiments of the invention, examples of which are shown in the drawings. Example is provided by way of explanation of the invention, and not meant as a limitation of the invention. For example, features illustrated or described as part of one embodiment can be used with another embodiment to yield still a further embodiment. It is intended that the present invention include these and other modifications and variations.

FIG. 1 shows in a highly schematic representation a spinning place of an embodiment shown as an example of the spinning machine in accordance with the invention. The spinning place is provided as a refining means specific to the spinning place with a separate drafting arrangement 1 (refining means 1) with three pairs of cylinders for example (feed rollers 2, middle rollers 3 with apron 4, and delivery roller 5). The spinning place is further provided with a yarn formation means 6 which substantially consists of a nozzle arrangement 7 and a pair of take-off rollers 8 for an air-vortex spinning method for example as well as a yarn winding device 9. A first mass sensor 10 is disposed upstream of the feed rollers 2 of the drafting arrangement 1, which mass sensor detects the fiber mass of the longitudinal fiber object supplied to drafting arrangement 1. A second mass sensor (so-called yarn cleaner) is disposed between the pair of take-off rollers 8 and the yarn bobbin 9, which second mass sensor detects the fiber mass of the produced yarn. The measured data as produced by the sensors 10 and 11 are supplied to a control and monitoring unit 12.

Feed rollers 2 and middle rollers 3 of the drafting arrangement 1 are driven by a first motor M.1 in such a way that the longitudinal fiber object is subjected to an even preliminary draft between said pairs of cylinders. The speed of motor M.1 is variable and is detected by a speed sensor Z.1. The motor M.1 is controlled by means of control data which are produced by the control and monitoring unit 12 on the basis of the measured data of the sensors 10 and 11. Delivery rollers 5 of the drafting arrangement 1 and take-off rollers 8 of the yarn formation means 6 are driven by a further motor M.2 in such a way that their circumferential speeds are provided with a ratio (spinning draft) which is suitable for the present yarn formation. The speed of said further motor M.2 is detected by the speed sensor Z.2 and can be kept constant with suitable means.

The drafting arrangement according to FIG. 1 corresponds substantially to an arrangement as is known per se from autoleveller draw frames. The control and monitoring unit 12 processes, as is known from autoleveller draw frames, the measured data of sensors 10 and 11 into control signals on the basis of which the speed of the first motor M.1 is regulated. As a result, any irregularities in the fiber mass as detected by sensor 10 are compensated with a suitable delay by varying the inflow speed (feed rollers) and varying the draft between the middle rollers 3 and the delivery rollers 5 (position of variable draft 20). With the help of this control it is possible to even out especially short-wave irregularities. Irregularities concerning fiber mass which are detected by the downstream sensor 11 in the completed yarn are further processed in the same manner. The closed-loop control in this case concerns one which is unable to even out any short-wave irregularities.

The spinning place as shown in FIG. 1 is therefore provided with a drafting arrangement which is controlled or regulated in the known manner, with the inflow speed being varied and the outflow speed being constant, meaning that the yarn formation can be performed with a constant delivery speed. This does not exclude that the yarn formation per se or the produced yarn can be monitored by way of sensors with respect to further quality features (not the regularity concerning the fiber mass) and the parameters of this yarn formation (e.g. the air flow in a spinneret) can be varied accordingly.

A spinning machine in accordance with the invention is therefore provided with a large number (e.g. 200) spinning places which are all equipped like the spinning place as shown in FIG. 1 for example. The entirety of all spinning places or a majority thereof can be coupled to the further motor M.2. The control and monitoring unit 12 can be used for the entirety of the spinning places or a majority thereof. Individually assigned to each spinning place are at least the pairs of feed rollers 2 and middle rollers 3 of the drafting arrangement, the sensors 10 and 11 and the first motor M.1 or a continuously drivable gear, which replaces said motor, between the central drive and each spinning place.

The longitudinal fiber objects are supplied to the spinning places from storage containers for the purpose of the integration of a spinning machine with spinning places according to FIG. 1 in a spinning mill arrangement. A direct and continuous supply from the carding machine or the autoleveller draw frame is only possible for example when a buffer with a sufficiently large buffer capacity is provided between the spinning place and the upstream apparatus, which buffer can be used to bridge variations in the inflow speed into the drafting arrangement without having to respectively control the upstream apparatus. Such a buffer can be designed as a simple slack of the longitudinal fiber object, which slack is monitored by way of sensors. On exceeding a lower or upper threshold of the buffer capacity, the spinning place is stopped or an upstream apparatus (carding machine, drafting arrangement) is triggered respectively so that its delivery speed is adjusted to the filling level of the buffer and/or the inflow speed into the spinning-place-internal drafting arrangement.

A drafting and constant yarn formation which is regulated spinner-place-internally according to FIG. 1 is especially applicable on spinning methods for which a change of the delivery speed of the yarn formation would cause a change in the yarn properties or for which a relatively rapid change of the delivery speed of the yarn formation is not possible for mechanical reasons. Such spinning methods are for example, for various reasons and as already mentioned above, ring spinning methods, friction spinning methods, can spinning methods, and open-end rotor spinning methods.

Figure 2:
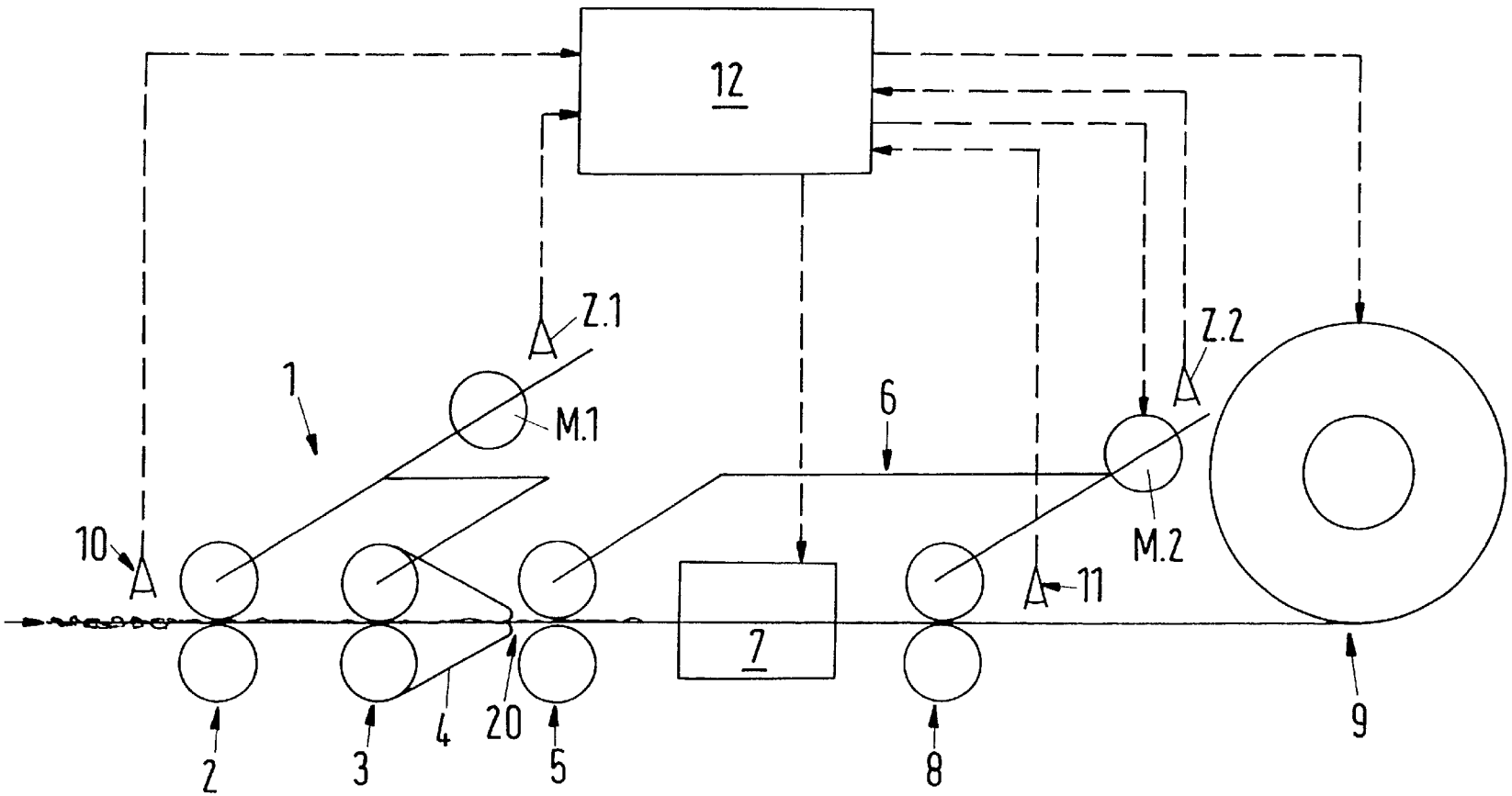
FIG. 2 shows a further spinning place by way of example with a drafting arrangement specific to the spinning places and an open-loop and closed-loop control of the drafting arrangement specific to the spinning places and the yarn formation (outflow) for evening the fiber mass per unit of length of the yarn produced in the spinning place.

FIG. 2 shows a spinning place with a spinning-place-internal drafting arrangement 1 and a yarn formation means 6 for a spinning machine in accordance with the invention, as is shown in FIG. 1. The same parts are designated with the same reference numerals. In contrast to the spinning place according to FIG. 1, the first motor M.1 is operated in this embodiment with constant speed and the further motor M.2 is triggered accordingly. In other words, irregularities concerning the fiber mass which are detected by the sensors 10 and 11 are compensated by variation of the outflow speed (delivery roller 5) of the drafting arrangement, which causes respective variations of the delivery speeds of the yarn formation means 6. The speeds of the take-off rollers 8 (operatively coupled according to FIG. 2 to the delivery roller 5 for a constant spinning draft) and the spooler 9 as well as optionally the yarn formation parameters (fluid supply to spinneret) must be variable and controllable by control signals as generated by the control and monitoring unit 12, as is indicated in FIG. 2 by respective arrows.

An open-loop/closed-loop control of the spinning places of a spinning machine according to the invention with spinning places according to FIG. 2 is especially suitable for a direct and continuous supply of longitudinal fiber objects to the spinning places and for spinning methods whose delivery speed is variable within a relatively wide margin without influencing the yarn properties. Such spinning methods are, as already mentioned above, especially air-vortex spinning methods. Since the inflow speed to the spinning-place-internal drafting arrangement is constant, it is possible to omit any buffering before said inflow or at least any large buffer capacity.

Figure 3:
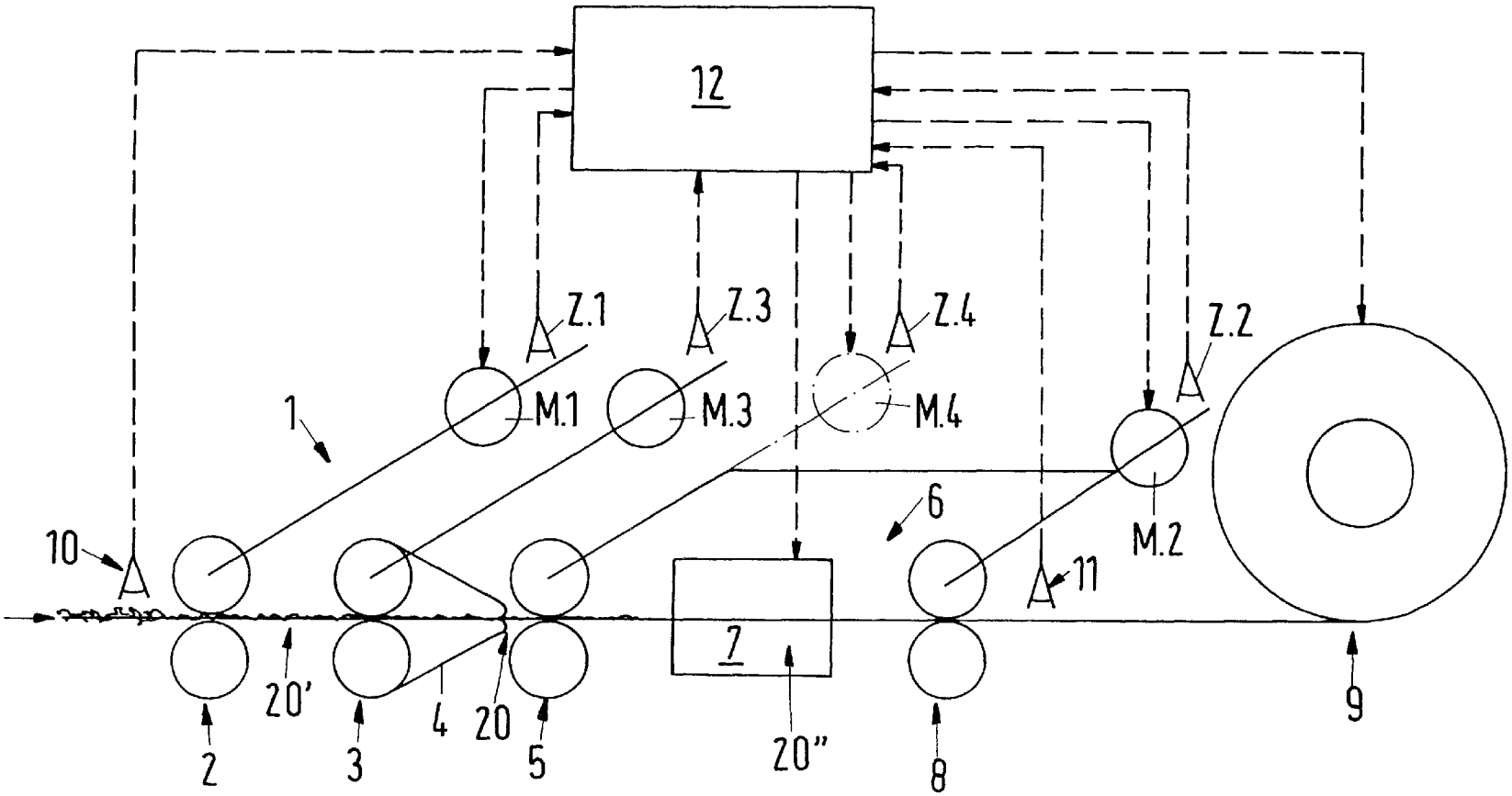
FIG. 3 shows a further spinning place by way of example with a drafting arrangement specific to the spinning places and an open-loop and closed-loop control of the drafting arrangement specific to the spinning places and the yarn formation (inflow and outflow) for evening the fiber mass per unit of length of the yarn produced in the spinning place.

FIG. 3 shows a spinning place for a spinning machine in accordance with the invention in which spinning place the open-loop/closed-loop control according to FIGS. 1 and 2 is essentially combined. Whereas the motors M.1 and M.2 have variable speeds and are controlled by the control and monitoring unit 12, only the pair of middle rollers 3 is driven by a third motor M.3 with constant speed. Two places of variable draft 20 and 20' are thus obtained. For such an open-loop/closed-loop control of the spinning places it is necessary to predetermine limit values for the first variable draft, the second variable draft, the spinning speed, further spinning parameters as well as optionally for buffer capacities upstream of the drafting arrangement 1. The operation of each spinning place must be kept or set within the predetermined limits when operation without exceeding the limits is not possible. The control unit can control the delivery speed of an apparatus (carding machine or drafting arrangement) which is upstream of the spinning machine and which supplies several spinning places directly and continuously with fiber material in such a way that the capacity is utilized optimally, meaning that the upstream apparatus and the spinning places are operated (or not operated for spinning places) such that the output of yarn is maximized.

In the spinning place according to FIG. 3 it is also possible to include the spinning draft (place of variable draft 20") into the control instead of or in addition to the preliminary draft (place of variable draft 20'). For this purpose the pair of delivery rollers 5 of drafting arrangement 1 and the pair of take-off rollers 8 of the yarn formation means 6 are mutually operatively disconnected, e.g. in such a way that they are driven by separate motors (motor M.4; shown in the dot-dash line).

The spinning place according to FIG. 3 is also suitable for an output variation of the spinning place in its entirety in order to adjust the output to the delivery output of an upstream apparatus supplying the longitudinal fiber object or for start spinning.

FIG. 4 shows again a spinning place with spinning-place-internal drafting arrangement 1 for a spinning machine in accordance with the invention, as has already been shown in FIGS. 1 to 3. In addition to the sensors 10 for an open-loop control unit and 11 for a long-wave closed-loop control, there are further possible sensor positions 10.1 (between feed rollers 2 and middle rollers 3 for an open-loop control), 11.1 (between middle rollers 2 and delivery rollers 5, directly after the place of variable draft 20, for a relatively short-wave closed-loop control) as well as 11.2 and 11.3 (between delivery rollers 5 and spinneret arrangement 7 and between spinneret arrangement 7 and take-off roller 8, both for closed-loop control). The measured data of sensor positions 10 and 10.1 (upstream of the place of variable draft 20) are used for open-loop control of the draft; the measured data of sensor positions 11, 11.1, 11.2 and 11.3 (downstream of the place of variable draft 20) are used for closed-loop control of the draft.

At least one mass sensor must be provided for each spinning place of the spinning machine in accordance with the invention. As has already been mentioned in connection with FIG. 1, there should preferably be two thereof, of which one is to be disposed upstream and one downstream of the place of variable draft 20.

Figure 4:
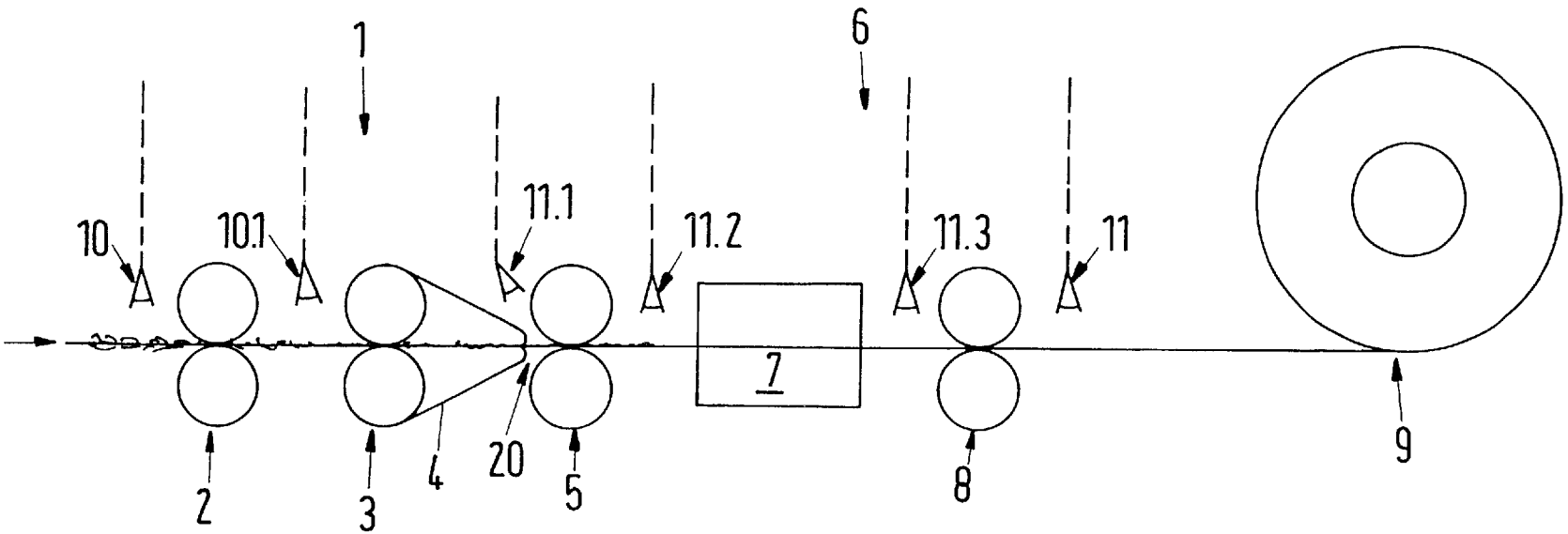
FIG. 4 shows further possible sensor positions for the spinning places according to FIGS. 1 to 3.
Figure 5:
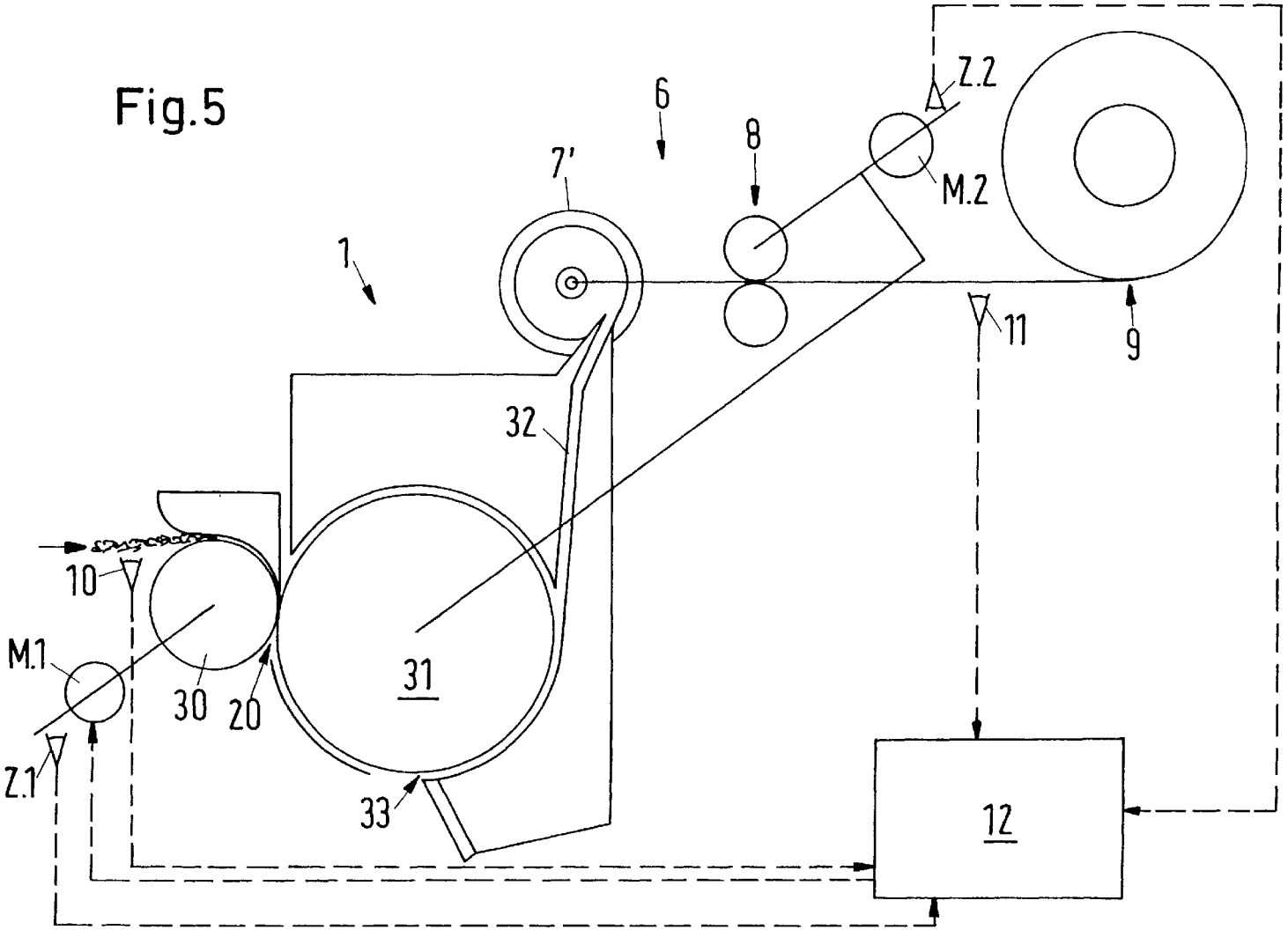
FIG. 5 shows a spinning place by way of example with an arrangement specific to a spinning place for opening a supplied fiber structure and an open-loop and closed-loop control of the opening arrangement specific to the spinning places and the yarn formation (inflow and outflow) for evening the fiber mass per unit of length of the yarn produced in the spinning place.

FIG. 5 shows a further spinning place by way of an example for a spinning machine in accordance with the invention. This spinning place is provided with a feed roller 30, an opening roller 31 and a fiber guide conduit 32 for the purpose of opening the longitudinal fiber object (refining means 1) as supplied to the spinning place, with the fibers being taken off by the opening roller 31 at separation place 33 through the fiber guide conduit 32 after the opening and being supplied to a yarn formation by rotor open-end spinning (rotor arrangement 7') for example. The apparatus parts downstream of the rotor arrangement 7' are substantially the same as for the spinning place according to FIGS. 1 to 4.

The mass sensor 10 detects the fiber mass of the fiber material as supplied to the feed roller 30. The mass sensor 11 detects the fiber mass of the finished yarn before the yarn bobbin 9. The feed roller 30 is driven by a first motor M.1 with variable speed, which motor is controlled by the control signals produced by the control and monitoring unit 12. Opening roller 31 and take-off roller 8 are driven by the second motor M.2 with a constant speed (constant spinning draft). The open-loop/closed-loop control of the spinning place corresponds substantially to the open-loop/closed-loop control as described in connection with FIG. 1, which means that the inflow speed to the refining means 1 is regulated and the delivery speed of the yarn formation means 6 remains substantially constant. The place of variable draft 20 is disposed between feed roller 30 and the opening roller 31.

The spinning place arrangement as shown in FIG. 5 is especially suitable for yarn formation according to the rotor open-end spinning method in which variations in the take-off speed cause changes in the yarn tension and thus in the yarn properties, such that the delivery speed of the yarn formation must be kept substantially constant for a high evenness of the yarn.

The spinning place as shown in FIG. 5 can also be controlled/regulated in analogy to FIGS. 2 and 3 with a respectively suitable spinning method, such that not only the opening step which is upstream of the yarn formation is varied, but also the yarn formation per se or both thereof.

Figure 6:
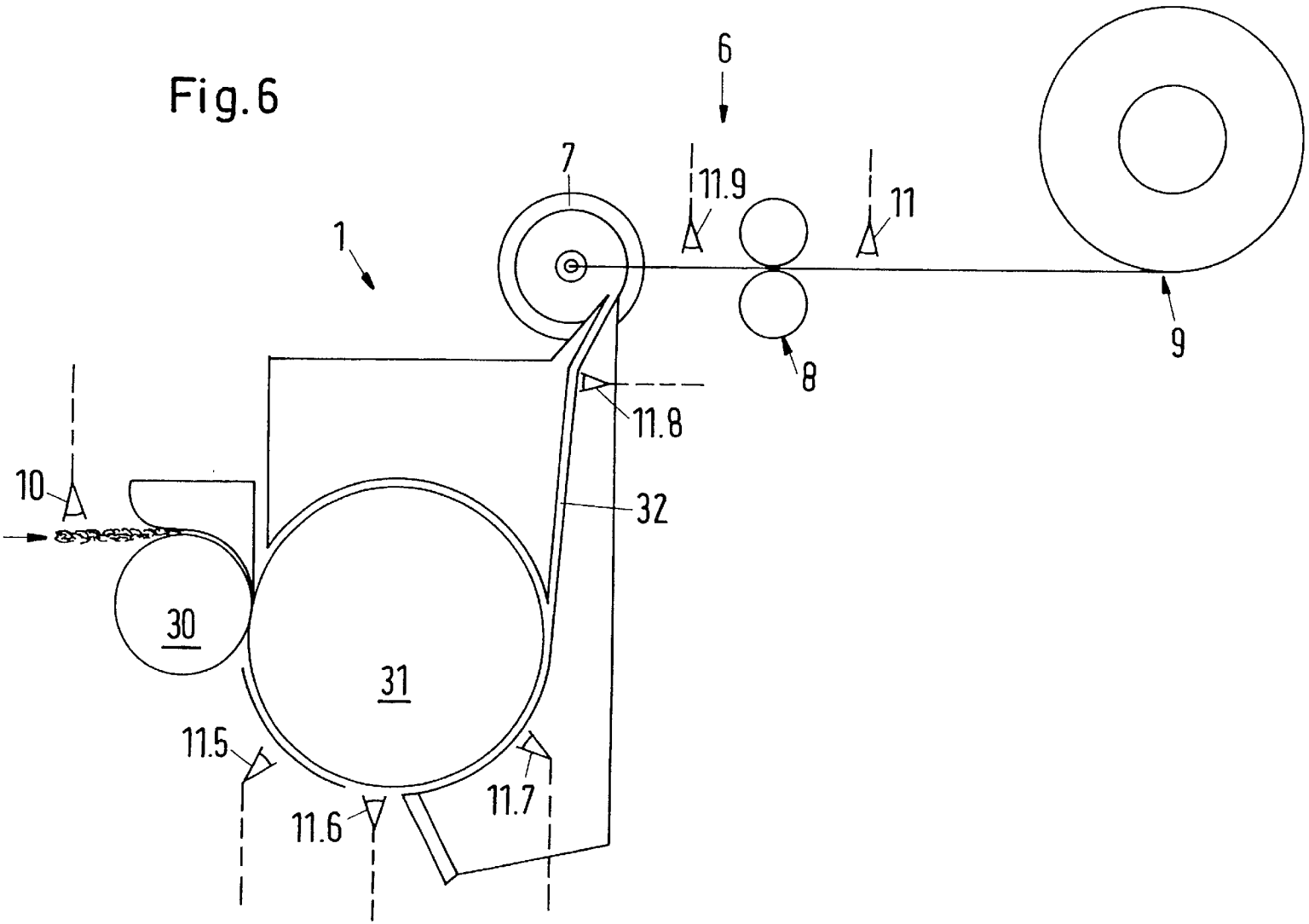
FIG. 6 shows further possible sensor positions for the spinning places according to FIG. 5.

FIG. 6 shows analogously to FIG. 4 further possible sensor positions 11.5 to 11.8 (in the zone of the opening roller 31 and the fiber guide conduit 32 for a relatively short-wave closed-loop control) and 11.9 (between rotor arrangement 7 and take-off rollers 8 for long-wave closed-loop control).

It should be apparent to those skilled in the art that various modifications and variations can be made to the embodiments of the invention shown and described herein without departing from the scope and spirit of the invention as set forth in the appended claims.

What is claimed is:

1. A spinning machine, comprising:

a plurality of spinning places, each said spinning place comprising an air-vortex yarn formation mechanism with which stable fiber material supplied to said spinning place in the form of a longitudinal object is spun into yarn independently at each said spinning place, each said spinning place further comprising a refining mechanism with which the longitudinal object is refined prior to the fiber material being supplied to said yarn formation mechanism;

each said refining mechanism independently drivable and controllable with respect to said other refining mechanisms;

at least one sensor disposed at each said spinning place to detect at least one measurable property correlated with fiber mass per unit of length; and a control and monitoring unit configured to receive and process data measured by said sensor, said control and monitoring unit operatively configured with said refining mechanism at an associated said spinning place for control of said refining mechanism as a function of said property detected and measured by said sensor independent of refining mechanisms at other said spinning places.

2. The spinning machine as in claim 1, wherein said sensor is disposed to detect and measure a property of the fiber material in said longitudinal object supplied to said spinning place.

3. The spinning machine as in claim 1, wherein each said refining mechanism comprises a driven variable speed in-flow side member, each said refining mechanism and yarn formation mechanism further comprising a generally constant speed out-flow member, said refining mechanism in-flow side members being independently controllable with respect to other said spinning places.

4. The spinning machine as in claim 1, wherein each said yarn formation mechanism and refining mechanism comprises a variable speed and independently controllable out-flow side member, and said refining mechanism further comprises a generally constant speed in-flow side member.

5. The spinning machine as in claim 1, wherein each said yarn formation mechanism and refining mechanism comprises a variable speed and independently controllable out-flow side member, and said refining mechanism further comprises a variable speed and independently controllable in-flow side member.

6. The spinning machine as in claim 1, wherein said refining mechanism comprises a fiber material drafting arrangement.

7. The spinning machine as in claim 6, wherein said drafting arrangement comprises a pair of feed rollers and a pair of delivery rollers, at least one of said pair of feed rollers and pair of delivery rollers being independently controllable with respect to said other spinning places.

8. The spinning machine as in claim 1, wherein said control and monitoring unit is configured for controlling steady-state operational at said spinning places.

9. The spinning machine as in claim 1, wherein each said refining mechanism comprises a driven variable speed in-flow side member that is independently controllable with respect to other said spinning places, said spinning machine further comprising a storage container arrangement configured to supply a fiber material longitudinal object to each said refining mechanism.

10. The spinning machine as in claim 1, wherein each said refining mechanism comprises a generally constant speed in-flow side member, said spinning machine further comprising a fiber material supply arrangement disposed operationally upstream of said spinning places to directly and generally continuously supply fiber material longitudinal objects to said spinning places.

11. The spinning machine as in claim 10, wherein said fiber material supply arrangement comprises a draw frame.

12. The spinning machine as in claim 10, wherein said fiber material supply arrangement comprises a carding machine.

13. The spinning machine as in claim 10, further comprising a buffer operationally disposed between said fiber material supply arrangement and said spinning places.

14. A spinning machine, comprising:

a plurality of spinning places, each said spinning place comprising a yarn formation mechanism with which stable fiber material supplied to said spinning place in the form of a longitudinal object is spun into yarn, each said spinning place further comprising a refining mechanism with which the longitudinal object is refined prior to the fiber material being supplied to said yarn formation mechanism;

each said refining mechanism independently drivable and controllable with respect to said other refining mechanisms;

at least one sensor disposed at each said spinning place to detect at least one measurable property correlated with fiber mass per unit of length; and a control and monitoring unit configured to receive and process data measured by said sensor, said control and monitoring unit operatively configured with said refining mechanism at an associated said spinning place for control of said refining mechanism as a function of said property detected and measured by said sensor independent of refining mechanisms at other said spinning places; and wherein said sensor is disposed to detect and measure a property of the yarn produced by said yarn formation mechanism.

15. A spinning machine, comprising:

a plurality of spinning places, each said spinning place comprising a yarn formation mechanism with which stable fiber material supplied to said spinning place in the form of a longitudinal object is spun into yarn, each said spinning place further comprising a refining mechanism with which the longitudinal object is refined prior to the fiber material being supplied to said yarn formation mechanism;

each said refining mechanism independently drivable and controllable with respect to said other refining mechanisms;

at least one sensor disposed at each said spinning place to detect at least one measurable property correlated with fiber mass per unit of length; and a control and monitoring unit configured to receive and process data measured by said sensor, said control and monitoring unit operatively configured with said refining mechanism at an associated said spinning place for control of said refining mechanism as a function of said property detected and measured by said sensor independent of refining mechanisms at other said spinning places;

wherein each said yarn formation mechanism and refining mechanism comprises a variable speed and independently controllable out-flow side member, and said refining mechanism further comprises a generally constant speed in-flow side member; and wherein said yarn formation mechanisms comprise an air-vortex spinning device, each spinning device further comprising a fluid supply and take-off rollers, said fluid supply and take-off rollers being independently controllable with respect to other said spinning places.

16. A spinning machine, comprising:

a plurality of spinning places, each said spinning place comprising a yarn formation mechanism with which stable fiber material supplied to said spinning place in the form of a longitudinal object is spun into yarn, each said spinning place further comprising a refining mechanism with which the longitudinal object is refined prior to the fiber material being supplied to said yarn formation mechanism;

each said refining mechanism independently drivable and controllable with respect to said other refining mechanisms;

at least one sensor disposed at each said spinning place to detect at least one measurable property correlated with fiber mass per unit of length; and a control and monitoring unit configured to receive and process data measured by said sensor, said control and monitoring unit operatively configured with said refining mechanism at an associated said spinning place for control of said refining mechanism as a function of said property detected and measured by said sensor independent of refining mechanisms at other said spinning places; and wherein said refining mechanism comprises a fiber material opening device.

17. The spinning machine as in claim 16, wherein said opening device comprises a feed roller, a opening roller, and a fiber guide conduit disposed to guide fibers from said opening roller to said yarn formation mechanism, said feed roller being independently controllable with respect to said other spinning places.

18. A spinning machine, comprising:

a plurality of spinning places, each said spinning place comprising a yarn formation mechanism with which stable fiber material supplied to said spinning place in the form of a longitudinal object is spun into yarn, each said spinning place further comprising a refining mechanism with which the longitudinal object is refined prior to the fiber material being supplied to said yarn formation mechanism;

each said refining mechanism independently drivable and controllable with respect to said other refining mechanisms;

at least one sensor disposed at each said spinning place to detect at least one measurable property correlated with fiber mass per unit of length; and a control and monitoring unit configured to receive and process data measured by said sensor, said control and monitoring unit operatively configured with said refining mechanism at an associated said spinning place for control of said refining mechanism as a function of said property detected and measured by said sensor independent of refining mechanisms at other said spinning places; and wherein said control and monitoring unit is configured for controlling start-spinning cycles at said spinning places.

* * * * *